United States Patent [19]

Kojima et al.

[11] Patent Number: 4,463,773

[45] Date of Patent: Aug. 7, 1984

[54] SAFETY SHUT-OFF VALVE

[75] Inventors: Tadashi Kojima; Tetsuo Uchihama, both of Fujisawa; Kazuyoshi Tanaka, Yokohama; Eiichi Morozumi, Ayase; Kentaro Inoue, Yokohama; Naomichi Shito, Tokyo, all of Japan

[73] Assignee: Yamatake-Honeywell Co., Ltd., Tokyo, Japan

[21] Appl. No.: 361,926

[22] PCT Filed: Nov. 20, 1981

[86] PCT No.: PCT/JP81/00351

§ 371 Date: Mar. 15, 1982

§ 102(e) Date: Mar. 15, 1982

[87] PCT Pub. No.: WO82/01756

PCT Pub. Date: May 27, 1982

[30] Foreign Application Priority Data

| | | | |
|---|---|---|---|
| Nov. 21, 1980 | [JP] | Japan | 55-165006 |
| Dec. 27, 1980 | [JP] | Japan | 55-188591 |
| Jan. 29, 1981 | [JP] | Japan | 56-10892 |

[51] Int. Cl.[3] ..... F16K 17/36

[52] U.S. Cl. ..... 137/38; 137/39; 137/110; 137/462; 251/25; 251/57

[58] Field of Search ..... 137/38, 39, 46, 110, 137/462; 251/25, 57; 431/22, 88, 89

[56] References Cited

U.S. PATENT DOCUMENTS

| | | | |
|---|---|---|---|
| 3,135,281 | 6/1964 | Morgan | 137/110 |
| 3,175,500 | 3/1965 | Zeigler | 60/469 |
| 4,075,928 | 2/1978 | Bitonti | 137/110 X |
| 4,167,194 | 9/1979 | Matsuda | 137/38 |
| 4,247,077 | 1/1981 | Banick | 251/25 |

FOREIGN PATENT DOCUMENTS

| | | | |
|---|---|---|---|
| 43-13889 | 6/1968 | Japan . | |
| 45-13843 | 6/1970 | Japan . | |
| 54-132821 | 10/1979 | Japan . | |
| 55-57771 | 4/1980 | Japan . | |
| 55-109862 | 8/1980 | Japan | 137/38 |

*Primary Examiner*—Robert G. Nilson
*Attorney, Agent, or Firm*—Clyde C. Blinn

[57] ABSTRACT

A safety shut-off valve opening a flow path between the primary and secondary sides in case of usual operation, while shutting off the aforesaid path in response to an emergency shut-off signal, and particularly such safety shut-off valve cannot be reset unitl it is confirmed that there is no more leakage of gas on the secondary side of the shut-off valve after the shut-off action was once effected, thereby to attaining a very high safeness.

12 Claims, 8 Drawing Figures

SAFETY SHUT-OFF VALVE

TECHNICAL FIELD

This invention relates to a safety shut-off valve automatically shutting off supply of fluid such as gas or the like, when abnormal conditions such as earthquake, leakage of combustion gas and the like are detected, and more particularly to a safety shut-off valve which cannot be reset until it is confirmed that there is no leakage of gas or the like on the secondary side after the shut-off action was once effected.

TECHNICAL BACKGROUND

In order to prevent poisoning, explosion and the like accidents due to leakage of gas or the like from occuring, safety shut-off valve which detect such leakage of gas or the like and automatically shut off the supply of such gas or the like have heretofore been developed. However, such conventional safety shut-off valves have such disadvantages that two electromagnetic valves are required, constructions of the valves become expensive, and controls of such constructions come to be complicated. Besides there is such a disadvantage that a conventional apparatus cannot particularly give an alarm, even if the apparatus was in shut-off condition by the leakage of gas or the like. Furthermore, conventional apparatuses are not provided with such means by which an apparatus cannot be reset until it is confirmed that there is no more leakage of gas or the like on the secondary side after the shut-off action was once effected. Thus, conventional safety shut-off valves are not sufficient in view of safety.

DISCLOSURE OF THE INVENTION

A principal object of the present invention is to provide a safety shut-off valve which can overcome disadvantages of conventional apparatuses as mentioned above and possesses extremely high safeness.

Another object of the present invention is to provide a safety shut-off valve with very high safeness which cannot be reset until it is confirmed that there is no more leakage of gas or the like on the secondary side of the shut-off valve after the shut-off action was once effected at the time when abnormal conditions such as earthquake and the like were detected.

Still another object of the present invention is to provide a useful safety shut-off valve in which either of two electromagnetic valves is replaced by a diaphragm valve and at the same time, an alarm switch is added, whereby the construction of the safety shut-off valve becomes inexpensive, besides raising an alarm signal at the time of shutting-off conditions comes to be also easy.

According to an embodiment of this invention, there is proposed a safety shut-off valve opening a flow path between the primary and secondary sides in case of usual operation, whilst shutting off said flow path in response to an emergency shut-off signal, which comprises an electromagnetic transference device for forcibly transferring fluid from an admission port into a pressure chamber through an exhaust port by means of electromagnetic force, a main valve device consisting of a responsive body in response to the pressure in said pressure chamber and a main valve body connected with said responsive body, and an opening and closing means for controlling the opening and closing of a branch path for discharging the fluid in said pressure chamber by communicating therewith in order to close said main valve deveice by releasing the pressure upon receipt of the aforesaid shut-off signal.

THE BEST MODE FOR EMBODYING THE INVENTION

Figure 1:
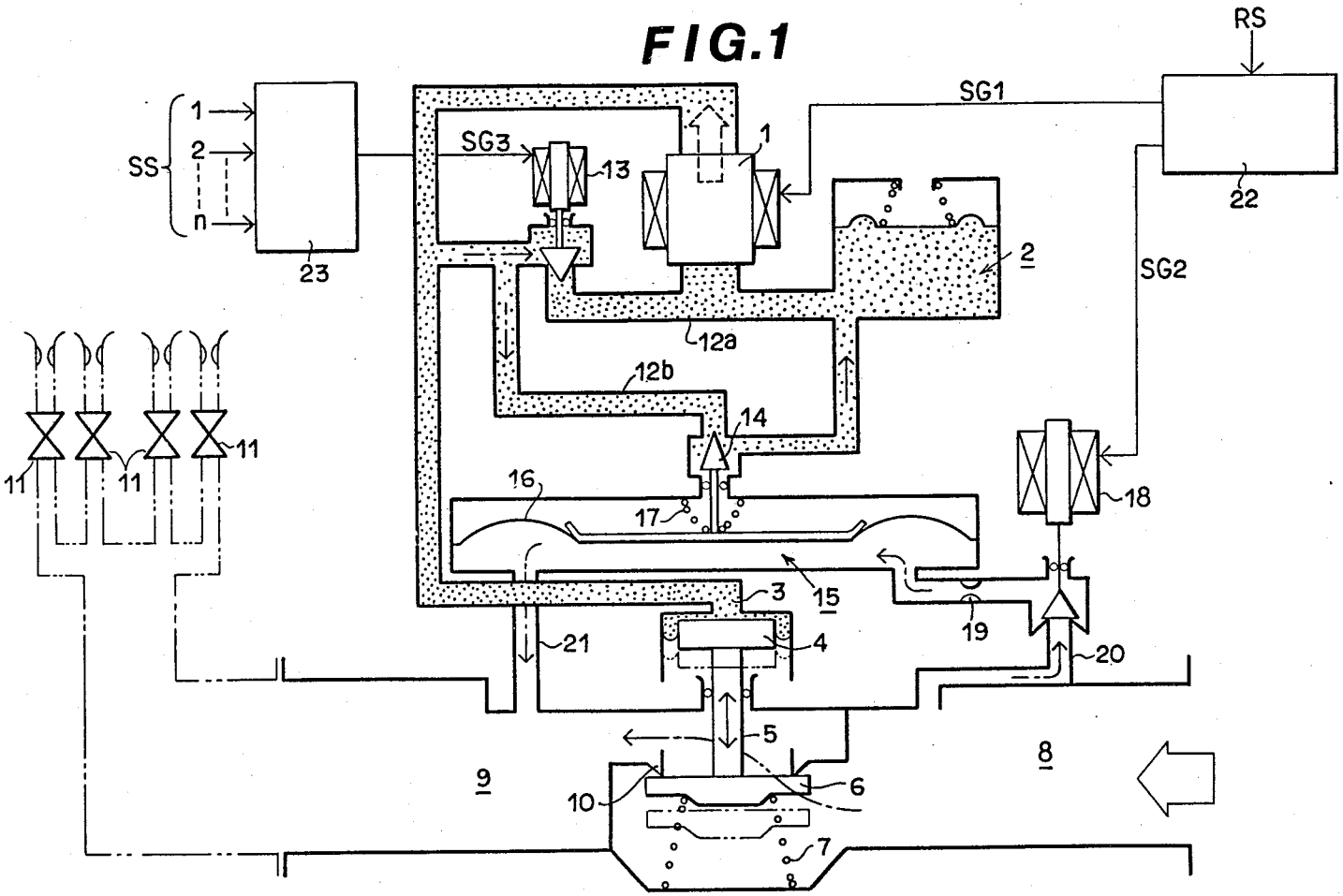
FIG. 1 is a flow sheet of a gas safety shut-off valve in accordance with one embodiment of the present invention.

Referring to FIG. 1, an electromagnetic pump 1 functions to forcibly transfer the fluid (for example, oil) contained in a first chamber 2 into a second chamber 3. A responsive body 4 operates in response to the pressure in the second chamber 3 to open and close a valve body 6 connected to the responsive body 4 through a rod 5. The valve body 6 is urged by the action of a spring 7 onto a valve seat 10 defined in between an inlet path 8 and an outlet path 9 in a direction in which the valve body 6 is pressed into contact with the valve seat 10. The outlet path 9 is connected to individual gas instruments (not shown) through valves 11, respectively.

Furthermore, a first communicating path 12*a* for returning the fluid forcibly transferred into the second chamber 3 to the first chamber 2 is provided with an electromagnetic valve 13, while a second communicating path 12*b* is provided with a diaphragm valve 14. The diaphragm valve 14 is supported by a diaphragm 16 being in contact with a diaphragm chamber 15 and urged by a spring 17 in its opening direction. The diaphragm chamber 15 is communicated with the inlet path 8 through an electromagnetic valve 18 and a path 20 having an orifice 19 and at the same time, communicated also with the outlet path 9 through a path 21.

In addition, a sequence control circuit 22 for controlling the electromagnetic pump 1 and electromagnetic valve 18 as well as a detection control circuit 23 for controlling the electromagnetic valve 13 are disposed on the safety shut-off valve, respectively. The operations of these circuits will be described later.

Figure 2:
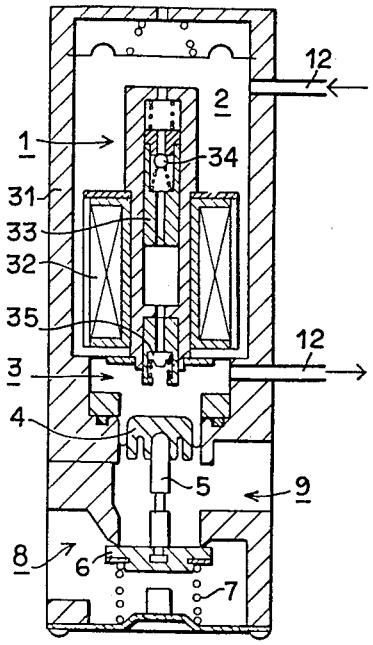
FIG. 2 is a longitudinal sectional view showing a specific construction of an essential part of the safety shut-off valve in FIG. 1.

FIG. 2 shows one example of a specific construction of a mechanism which operates to open and close the valve body 6 by the action of the electromagnetic pump 1. The electromagnetic pump 1, responsive body 4 and valve body 6 are contained in a casing designated by reference numeral 31 in FIG. 2. The electromagnetic pump 1 possesses a coil 32 to which a driving signal SG 1 is supplied from the sequence control circuit 22 and a plunger 33 moving reciprocally in the central portion of the coil 32. Due to reciprocating motion of the plunger 33, the fluid in the first chamber 2 is forcibly transferred to the second chamber 3 by the actions of check valves 34 and 35. The responsive body 4 is moved to the lower part in FIG. 2 by increasing the pressure in the second chamber 3 to transfer the valve body 6 to its open position against the spring 7. This condition is maintained until the pressure in the second chamber 3 decreases by opening the communicating pathes 12.

Figure 3A:
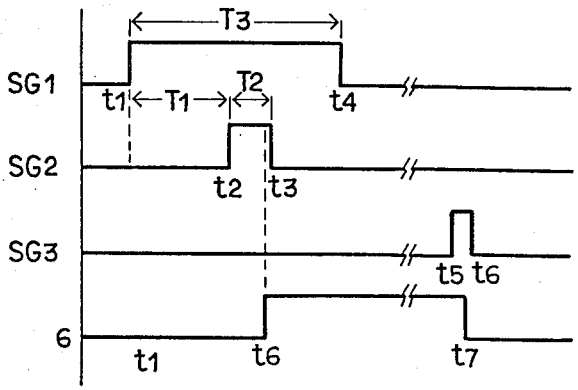
FIGS. 3*a* and 3*b* are sequential diagrams illustrating operations of the aforesaid safety shut-off valve, respectively.

An action for moving the valve body 6 being in the close position to the open position is effected by supplying a reset signal to the sequence control circuit 22 from the outside. The sequence control circuit 22 supplies the driving signal SG 1 to the electromagnetic pump 1 for a prescribed period of time T 3 from the point of time t 1 when a reset signal RS was supplied, and a driving signal SG 2 to the electromagnetic valve 18 for a fixed period of time T 2 after the lapse of a set time T 1 from the point of time t 1, respectively. The relationship between the driving signals SG 1 and SG 2 is as illustrated in FIG. 3. In this arrangement, when it is assumed that a shut-off signal SS exhibiting any abnormal condition involving, for instance, an earthquake detection signal, gas leak detection signal or the like has not yet been supplied to the detection control circuit 23, the electromagnetic valve 13 remains closed. On the other hand, when the electromagnetic valve 18 is opened by means of the driving signal SG 2, the gas in the inlet path 8 flows into the outlet path 9 through the path 20, diaphragm chamber 15 and path 21. In this case, if all the valves 11 are closed and there is no gas leakage, the secondary pressure in the outlet path 9 increases gradually and finally the pressure comes to be equal to the primary pressure in the inlet path 8, so that the pressure acts on the diaphragm chamber 15. Owing to this situation, the diaphragm valve 14 is transferred to the close position by the diaphragm 16 against the action of the spring 17. Thus, both the communicating pathes 12*a* and 12*b* come to be in shut-off condition, so that the pressure in the second chamber 3 is heightened by means of the fluid forcibly transferred with the electromagnetic pump 1 which has already been actuated, and the valve body 6 is moved to the open position by means of the responsive body 4. As a consequence, this condition is maintained even after the action of the electromagnetic pump 1 stopped at a point of time t 4.

Next, when there arises any abnormal condition and the shut-off signal SS is supplied, the detection control circuit 23 supplies a driving signal SG 3 to the electromagnetic valve 13. Thus, the electromagnetic valve 13 opens one 12*a* of the communicating pathes to release the pressure of fluid in the second chamber 3. As a result, the responsive body 4 rises until the valve body 6 is pressed into contact with the valve seat 10, so that the supply of gas into the outlet path 9 is shut off.

Figure 3B:
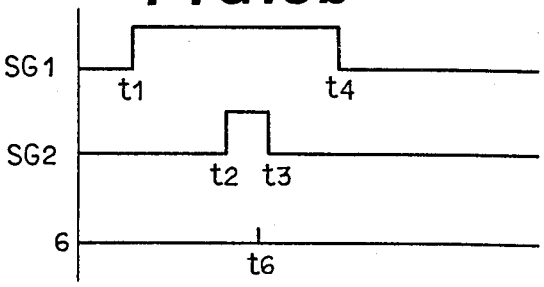

Furthermore, in the case where there is gas leakage on the side of the outlet path 9 when a reset signal RS was fed to the sequence control circuit 22, the electromagnetic pump 1 operates as illustrated in FIG. 3*b* and then, even if the electromagnetic valve 18 comes to be in open state, the secondary pressure on the side of the outlet path 9 does not increase to a set value before the fixed time T 2 elapses. Consequently, the electromagnetic valve 18 closes before the diaphragm valve 14 becomes the close condition. Therefore, the pressure in the pressure chamber 3 does not increase so that the valve body 6 does not remove to the open position.

Figure 4:
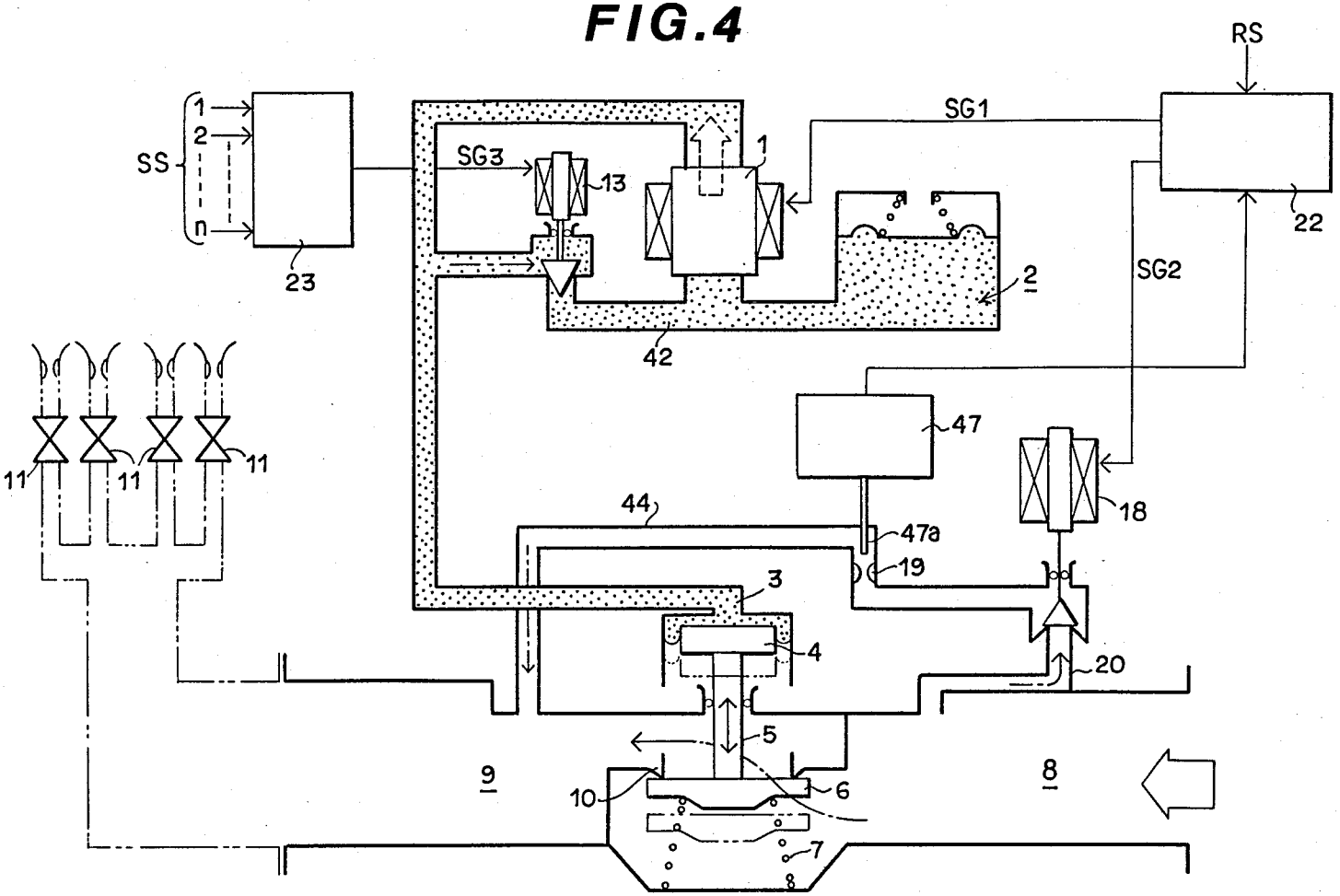
FIG. 4 is a flow sheet of a gas safety shut-off valve in accordance with another embodiment of the present invention.

FIG. 4 is a flow sheet of a gas safety shut-off valve in accordance with another embodiment of the present invention in which the same reference numerals or characters with those of FIG. 1 designate the same parts as those of FIG. 1.

A single communicating path 42 is disposed for returning the fluid forcibly transferred to the second chamber 3 to the first chamber 2, and this communicating path is arranged so as to be opened and closed by means of the electromagnetic valve 13. On one hand, a by-pass path 44 bypassing the valve body 6 to communicate the inlet path 8 with the outlet path 9 is provided with the electromagnetic valve 18 and the orifice 19. Besides a detecting end 47*a* of a gas stream detecting means 47 such as anemometer for detecting the gas stream flowing through the by-pass path 44 is inserted therein.

An action for moving the valve body 6 in the close position to the open position is effected by supplying the reset signal RS to the sequence control circuit 22 from the outside. The sequence control circuit 22 feeds the driving signal SG 2 to the electromagnetic valve 18 for a prescribed period of time from the point of time when the reset signal RS was supplied. In this arrangement, when it is assumed that the shut-off signal SS exhibiting any abnormal condition involving, for example, an earthquake detection signal, gas leak detection signal or the like has not yet been supplied to the detection control circuit 23, the electromagnetic valve 13 remains closed. On the other hand, when the electromagnetic valve 18 is opened by means of the driving signal SG 2, the gas in the inlet path 8 tends to flow into the outlet path 9 through the by-pass path 44. In this case, if all the valves 11 are closed and there is no gas leakage, a flow rate of the gas passing through the by-pass path 44 is very small. Therefore, the gas stream detecting means 47 does not detect gas stream and in this condition, the sequence control circuit 22 transmits the driving signal SG 1 to the electromagnetic pump 1 in accordance with a prescribed sequence and at the same time, shuts off the driving signal SG 2 which has been supplied to the electromagnetic valve 18. As a consequence, the by-pass path 44 is closed and on one hand, the valve body 6 is moved to the open position to complete a reset operation.

Then, when any abnormal condition arises and the shut-off signal SS is supplied, the detection control circuit 23 supplies a driving signal SG 3 to the electromagnetic valve 13. Thus, the electromagnetic valve 13 opens the communicating path 42 and releases a pressure of the fluid in the second chamber 3. As a result, the responsive body 4 rises until the valve body 6 is pressed into contact with the valve seat 10, so that the supply of gas into the outlet path 9 is shut off.

Moreover, in the case where there is gas leakage on the side of the outlet path 9 when the reset signal RS was fed to the sequence control circuit 22, the gas flows continuously from the inlet path 8 to the outlet path 9 through the by-pass path 44 upon opening of the electromagnetic valve 18. This gas stream is immediately detected by the gas stream detecting means 47 having the detecting end 47*a* inserted into the by-pass 44, and the resultant detection signal is transmitted to the sequence control circuit 22. When the sequence control circuit 22 receives the detection signal from the gas stream detecting means 47, the circuit 22 shuts off the driving signal SG 2 supplied to the electromagnetic valve 18. In such condition, the driving signal SG 1 is not transmitted to the electromagnetic pump 1. Therefore, the valve body 6 remains maintained in the close position, and gas is not supplied to the outlet path 9.

Figure 5:
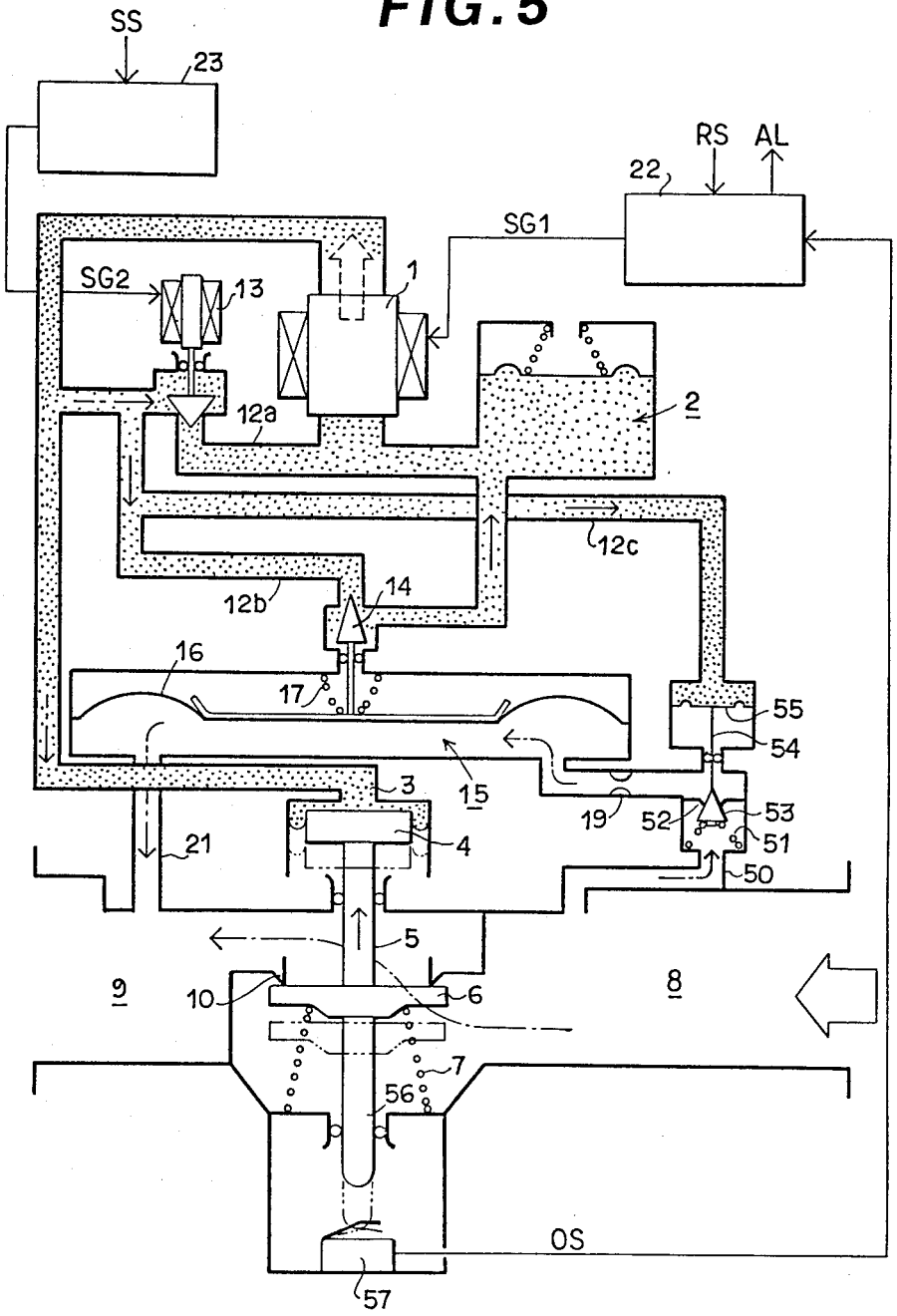
FIG. 5 is a flow sheet of a safety shut-off valve in accordance with a further embodiment of the present invention.

FIG. 5 is a flow sheet of a gas safety shut-off valve in accordance with still another embodiment of the present invention in which the same reference numerals or characters with those of FIG. 1 designate the same parts as those of FIG. 1. The diaphragm chamber 15 is communicated with the inlet path 8 through a path 50 having an undermentioned auxiliary diaphragm valve and the orifice 19 and at the same time, with also the outlet path 9 through the path 21.

The sequence control circuit 22 for controlling the electromagnetic pump 1 as well as the detection control circuit 23 for controlling the electromagnetic valve 13 are disposed, respectively, in the gas safety shut-off valve. The operations therefor will be described hereinbelow.

In addition, the auxiliary diaphragm valve 53 being urged by means of a spring 51 to be in pressed contact with a valve seat 52 is inserted into the path 50, besides the auxiliary diaphragm valve is connected to an auxiliary diaphragm 55 by means of a rod 54. Thus, it is arranged that the fluid pressure from the electromagnetic pump 1 is applied to the auxiliary diaphragm 55 through a communicating path 12*c* branched from the communicating path 12*a*.

Figure 6A:
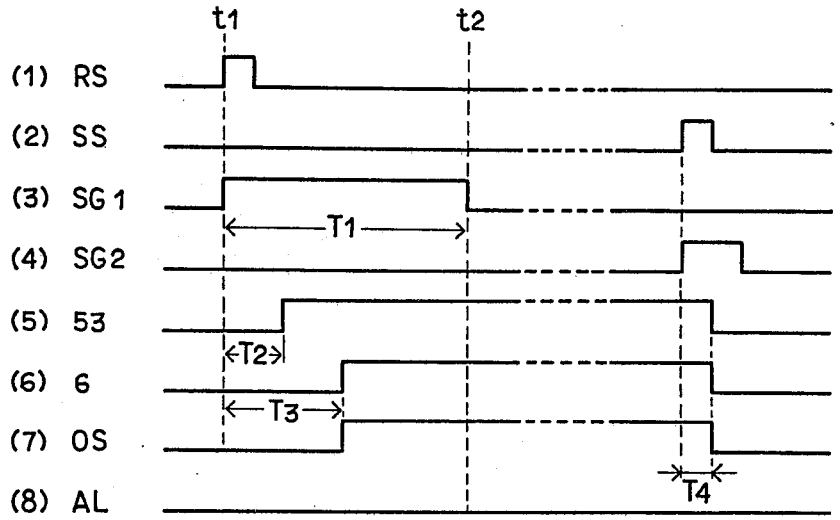
FIGS. 6*a* and 6*b* are sequential diagrams illustrating operations of the safety shut-off valve of FIG. 5, respectively.

Next, respective signals and responding situations of the respective parts are as illustrated in FIG. 6*a* as a timing chart in which the sequence control circuit 22 supplies the driving signal SG 1 to the electromagnetic pump 1 for a period of time from the point of time $t_1$ when the reset signal RS was given to a point of time at which the prescribed time $T_1$ elapses. Accordingly, a fluid pressure in the discharge side of the electromagnetic pump increases, and the increased pressure is applied to the auxiliary diaphragm 55, so that the auxiliary diaphragm valve 53 opens at first after the lapse of a delayed time $T_2$, if it has been arranged that a reaction of the auxiliary diaphragm valve 53 determined by an area of the auxiliary diaphragm 55 for receiving pressure and a tensile strength of the spring 53 is made to be smaller than that of the valve body 6 determined by an area of the responsive body 4 for receiving pressure and a tensile strength of the spring 7.

In this arrangement, when it is assumed that a shut-off signal SS exhibiting any abnormal condition involving, for instance, an earthquake detection signal, gas leak detection signal or the like has not yet been supplied to the detection control circut 23, the electromagnetic valve 13 remains closed in FIG. 5. On the other hand, when the auxiliary diaphragm valve 53 is opened, the gas in the inlet path 8 flows into the outlet path 9 through the path 50, diaphragm chamber 15 and path 21.

In this case, if all end valves disposed on the side of the outlet path 9 and which are omitted from FIG. 5 are closed and there is no gas leakage, the secondary pressure in the outlet path 9 on the basis of the primary pressure 8 in the inlet path 8 increases gradually, and finally the increased pressure comes to be equal to the primary pressure in the inlet path 8, so that the pressure acts on the diaphragm chamber 15. Owing to this situation, the diaphragm 16 is elevated against the action of the spring 17 to transfer the diaphragm valve 14 to the close position. Thus, both the communicating pathes 12*a* and 12*b* come to be in shut-off condition, so that the pressure in the second chamber 3 is further heightened in response to pressure of the fluid forcibly transferred with the electromagnetic pump 1 which has already been actuated, and the valve body 6 is moved to the open position by means of the responsive body 4 after the lapse of a delayed time T 3. As a consequence, this condition is maintained even after the action of the electromagnetic pump 1 stopped at the point of time t 2.

Next, when there arises any abnormal condition and the shut-off signal SS is supplied, the detection control circuit 23 supplies the driving signal SG 2 to the electromagnetic valve 13. Thus, the electromagnetic valve 13 opens one 12*a* of the communicating pathes to release the pressure of fluid in the second chamber 3. As a result, the responsive body 4 rises until the valve body 6 is pressed into contact with the valve seat 10, so that the supply of gas into the outlet path 9 is shut off after the lapse of a delayed time T 4 and at the same time, the auxiliary diaphragm valve 53 is also closed.

In this gas safety shut-off valve, however, the rod is extended through the valve body 6 to define an extension part 56, so that if a main valve device consisting of the valve body 6 and valve seat 10 is opened, the extension part 56 projects to drive a switch 57 which is placed under the extension part and in which a mechanical opening and closing means such as a microswitch or the like is used. Thus, it is arranged that an open signal OS is transmitted in accordance with the operation of the switch, and such signal is given to the sequence control circuit 22.

Therefore, the sequence control circuit 22 judges either the presence or absence of gas leakage dependent upon the fact whether the open signal OS generates or not during the prescribed period of time T 1, and in addition it becomes possible to transmit an alarm signal AL. As a consequence, when the valve body 6 opens during the prescribed period of time T 1 to generates the open signal OS, the alarm signal AL is not transmitted, whilst if there is no generation of the open signal OS even though the prescribed period of time T 1 has lapsed, the alarm signal AL is transmitted as illustrated in FIG. 6*b*.

Figure 6B:
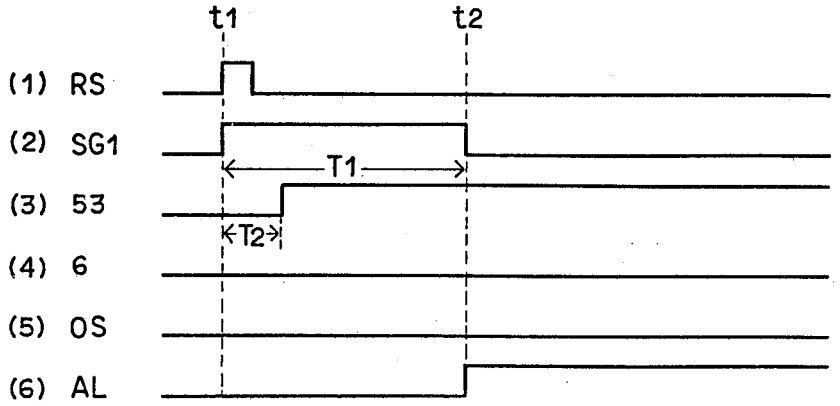

Namely, in the case where there is gas leakage on the side of the outlet path 9 when the reset signal RS was fed to the sequence control circuit 22, even though the electromagnetic pump 1 is operated by means of the driving signal SG 1 as illustrated in FIG. 6*b* and then, the auxiliary diaphragm valve 53 comes to be the open condition, the secondary pressure on the side of the outlet path 9 does not reach a set value during the prescribed period of time T 1. Accordingly, the electromagnetic pump 1 stops before the diaphragm valve 14 closes, so that the pressure in the second chamber 3 remains unelevated. Thus, the valve body 6 does not shift to the open position and there is no generation of the open signal OS, so that the alarm signal AL is transmitted, whereby either an alarm sound by means of a buzzer, bell or the like is generated or an alarm lamp is lighted.

In addition, a switch which is constructed in such that a permanent magnet is secured to a movable part such as the rod 5, valve body 6 or the like in the main valve device, besides a reed switch, magnetic detecting element and the like are opposedly disposed to the secured permanent magnet may also be utilized as the switch 57.

Furthermore, the present invention can variously be modified, for instance, a supervision time before the open signal OS is generated is not set to the prescribed period of time T 1 which is identical to the driving signal SG 1, but it may be set by means of a separate timer in the sequence control circuit 22 which may be constructed by various logical operation circuits and a timer etc.

As mentioned above, in accordance with the present invention, the safety shut-off valve immediately effects a shut-off operation when a shut-off signal such as an earthquake detection signal is supplied and in addition, this safety shut-off valve does not effect the open operation until it is confirmed that there is no more leakage of gas on the secondary side of the safety shut-off valve after the reset operation was once effected. Therefore, the safety shut-off valve of this invention maintains highly the required safeness as a gas safety shut-off valve, besides there is no danger of effecting an erroneous operation in the safety shut-off valve. Moreover, the detection of gas leakage on the secondary side is carried out in accordance with the presence or absence of gas stream in the by-pass path in the gas safety shut-off valve of the invention. Accordingly, a time required for the detection can remarkably be shortened in the safety shut-off valve of this invention as compared with a case in which another means such as a means for detecting an increase of gas pressure on the secondary side is applied. Furthermore, if the gas safety shut-off valve is arranged in such that a driving signal is supplied to the electromagnetic valve 1 for only a short period of time before the electromagnetic valve 18 opens to open the valve body 6, and then the valve body is again closed, thereafter the electromagnetic valve 18 is opened, the presence or absence of gas leakage can be detected for a short period of time even in case where a capacity on the secondary side is large. In addition, leakage of gas can be detected, besides the supply of gas can automatically be brought on the shut-off condition by the simple and inexpensive construction according to the present invention. At the same time, the detection whether or not the supply of gas is started can positively be effected by such construction as described above, and an alarm signal can be raised on the basis of such detection, so that remarkable effects can be attained in view of ensuring safeness in various gas installations.

We claim:

1. A safety shut-off valve opening a flow path between the primary and secondary sides in case of normal operation while shutting off said flow path in response to an emergency shut-off signal, which comprises:

an electromagnetic transference device for forcibly transferring fluid from an admission port into a pressure chamber through an exhaust port by means of electromagnetic force, a main valve device consisting of a responsive body operated in response to a pressure in said pressure chamber and a first valve connected for operation by said responsive body, an opening and closing means for controlling the opening and closing of a branch path for discharging the fluid in said pressure chamber in order to close said main valve device by releasing said pressure upon receipt of said shut-off signal, a by-pass path communicating the primary side with the secondary side of said main valve device, a valve control device for controlling a second valve which opens said by-pass path during merely a period in which a reset signal is supplied, and a leak detecting means for detecting leak by existing gas flowing through said by-pass path from the primary side to the secondary side due to said leak on the secondary side of said main valve device in the condition in which said second valve opens.

2. A safety shut-off valve as defined in claim 1 wherein said safety shut-off valve is a gas safety shut-off valve, and said electromagnetic transference device is an electromagnetic pump energized by an electromagnetic coil.

3. A safety shut-off valve as defined in claim 2 wherein said electromagnetic pump is a pump for forcibly transferring a circulating oil, and said branch path is a by-pass path for the circulating oil defined in between the admission port and exhaust port of said electromagnetic pump.

4. A safety shut-off valve as defined in claim 3 wherein said valve control device is provided with a sequence control means for opening said second valve driven together with said electromagnetic pump in only the case of resetting said safety shut-off valve.

5. A safety shut-off valve as defined in claim 3 wherein said leak detecting means is provided with a diaphragm responding to the pressure on said secondary side, a third valve responding to the action of said diaphragm, and a second by-pass branch path on which said third valve is disposed and which is further connected to said by-pass branch path in parallel thereto.

6. A safety shut-off valve opening a flow path between the primary and secondary sides in case of normal operation, while shutting off said flow path in response to an emergency shut-off signal, which comprises:

an electromagnetic transference device for forcibly transferring fluid from an admission port into a pressure chamber through an exhaust port by means of electromagnetic force pressure means for varying the pressure in said pressure chamber, a main valve device consisting of a responsive body operative in response to a first pressure in said pressure chamber and a first valve connected for operation by said responsive body, an opening and closing means for controlling the opening and closing of a branch path for discharging the fluid in said pressure chamber in order to close said main valve device by releasing said pressure upon receipt of said shut-off signal, a by-pass path communicating the primary side with the secondary side of said main valve device, and a leak detecting means connected to said pressure chamber for detecting a leak by operating a second valve for opening said by-pass path only when the pressure of said pressure chamber comes to be equal to a second pressure and there exists fluid flowing through said by-pass path from the primary side to the secondary side due to said leak on the secondary side of said main valve device.

7. A safety shut-off valve as defined in claim 6 wherein said safety shut-off valve is a gas safety shut-off valve, and said electromagnetic transference device is an electromagnetic pump energized by an electromagnetic coil.

8. A safety shut-off valve as defined in claim 7 wherein said electromagnetic pump is a pump for forcibly transferring a circulating oil, and said branch path is a by-pass path for the circulating oil defined in between the admission port and exhaust port of said electromagnetic pump.

9. A safety shut-off valve as defined in claim 8 wherein said valve control device is provided with a sequence control means for opening said second valve by a variably driving pressure by means of said electromagnetic pump in accordance with said variable means in only the case of resetting said safety shut-off valve.

10. A safety shut-off valve as defined in claim 9 wherein said leak detecting means is provided with a diaphragm responding to the pressure on said secondary side, a third valve responding to the action of said diaphragm, and a second by-pass branch path on which said third valve is disposed and which is further connected to said by-pass branch path in parallel thereto.

11. A safety shut-off valve as defined in claim 10 wherein said by-pass path on which said second valve is disposed is provided with an orifice.

12. A safety shut-off valve as defined in claim 11 wherein said main valve device is provided with a switch operated by opening said first valve, and said sequence control means is provided with a means electrically connected to said switch.

* * * * *